US005216910A

United States Patent [19]

Lin

[11] Patent Number: 5,216,910

[45] Date of Patent: Jun. 8, 1993

[54] AUXILIARY LOCK WITH AN ANTI-BREAKAGE DEVICE

[76] Inventor: Jui-Chang Lin, No. 297, Bor Ay Road, Kaohsiung City, Taiwan

[21] Appl. No.: 939,617

[22] Filed: Sep. 2, 1992

[51] Int. Cl.[5] ..... E05B 63/00

[52] U.S. Cl. ..... 70/370; 70/417; 70/449; 70/452

[58] Field of Search ..... 70/370, 381, 417, 447, 70/448, 449, 451, 454, 452

[56] References Cited

U.S. PATENT DOCUMENTS

| | | | |
|---|---|---|---|
| 2,126,391 | 8/1938 | Jacobi | 70/417 |
| 2,487,803 | 11/1949 | Heimann | 70/370 |
| 3,404,549 | 10/1968 | Best | 70/449 |
| 3,514,983 | 6/1970 | Krook et al. | 70/370 |
| 3,990,277 | 11/1976 | Mullich | 70/107 |
| 4,073,172 | 2/1978 | Schlage | 70/417 |
| 4,129,019 | 12/1978 | Urdal | 70/107 |
| 4,183,563 | 1/1980 | Stevens | 292/34 |
| 4,338,804 | 7/1982 | Solovieff | 70/417 X |
| 4,418,552 | 12/1983 | Nolin | 70/107 |
| 4,587,816 | 5/1986 | Garcia | 70/417 |
| 4,679,418 | 7/1987 | Allen | 70/417 X |
| 4,709,565 | 12/1987 | Lin | 70/107 |
| 4,841,754 | 6/1989 | Jones | 70/452 X |

*Primary Examiner*—Lloyd A. Gall

*Attorney, Agent, or Firm*—Jacobson, Price, Holman & Stern

[57] ABSTRACT

An auxiliary lock with an anti-breakage device having a seat combined with a base and an inner ring covered with an outer ring, a latch unit being deposited in the housing and having a recessed opening in an outer end for a reinforcing plate to fit therein and then a face plate sealing up the reinforcing plate to protect the latch unit from breakage by illegal attempt.

2 Claims, 2 Drawing Sheets

AUXILIARY LOCK WITH AN ANTI-BREAKAGE DEVICE

BACKGROUND OF THE INVENTION

A common door usually has only one lock, and for higher safety a second lock, i.e. an auxiliary lock is added. For example, U.S. Pat. Nos. 3,990,277, 4,129,019, 4,183,563, 4,418,552 and 4,709,565 devised two locks to be locked and unlocked at the same time, and the lock added is the auxiliary lock which is to be rotated to open a door with a key from outside and to be rotated to open the door by rotating after pushing a turning button from inside. Therefore, firmness and hardness of the auxiliary lock is especially considered important, and developed countries have an industrial testing standard for it, such as punching test, a pulling test, a torque test, etc, so an auxiliary lock has to pass those tests for preventing it from illegal breakage. To attain this purpose, those patents mentioned above mostly have comparatively a hard housing made of cast for containing a latch unit, to a resultant rather high cost. But they still can hardly pass the torque test, that is, the latch unit cannot resist boring of more than two holes in it and the latch is forcibly rotated illegally by means of a tool like a wrench to open the door.

SUMMARY OF THE INVENTION

In order to pass the above-mentioned tests, an auxiliary lock with an anti-breakage device in this invention has a housing composed of a seat, a base, an inner ring and an outer ring, and a latch unit is deposited inside a tubular post of the seat and an inner annular lip of the outer ring. The latch unit has a recessed opening in an outer end for a reinforcing plate made of very hard material to fit therein to resist illegal boring and then a face plate is further provided to seal up the reinforcing plate to prevent the latch unit from being broken by boring.

DETAILED DESCRIPTION OF THE INVENTION

Figure 1:
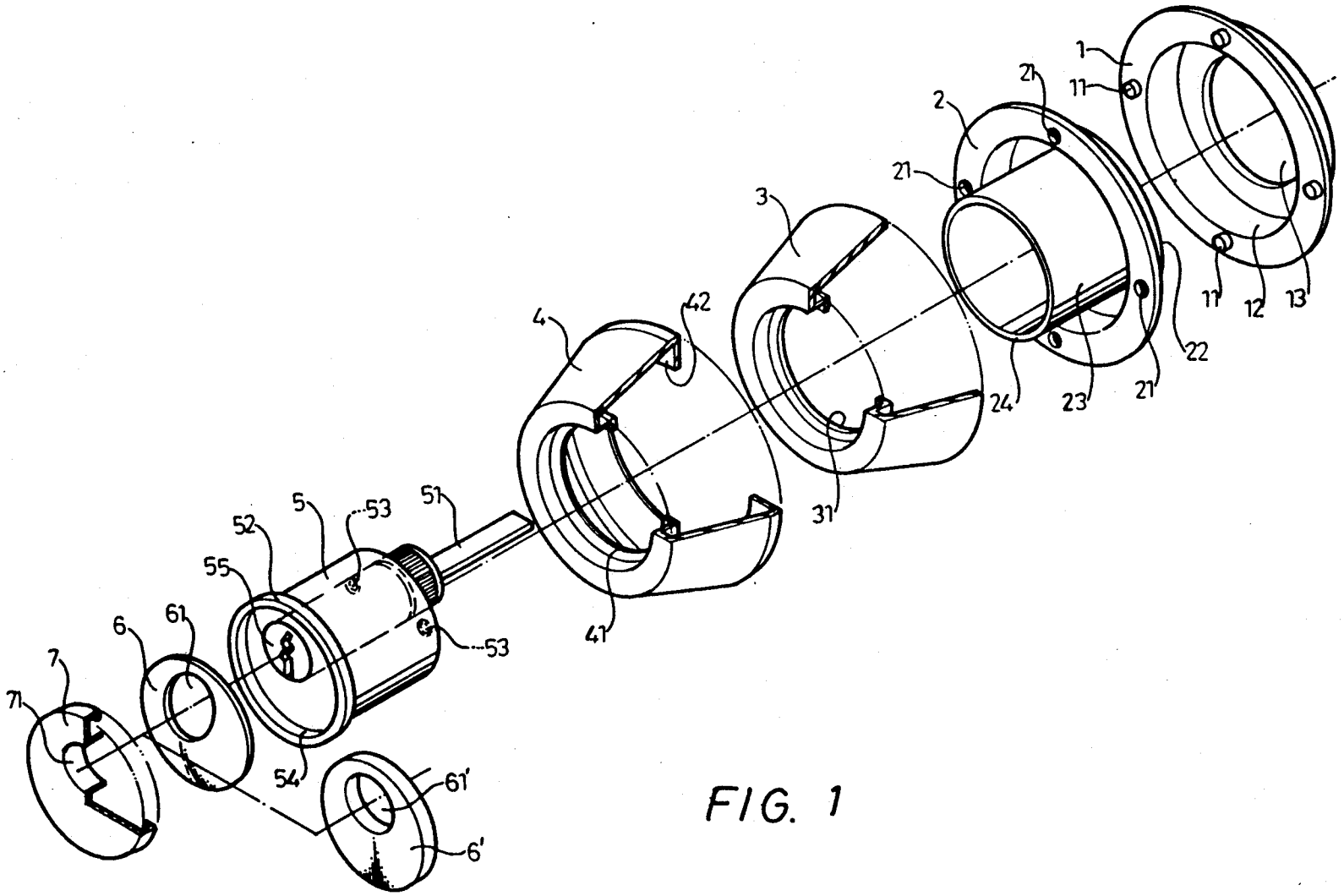
FIG. 1 is an exploded perspective view of an anti-breakage device for an auxiliary lock in the present invention.

An auxiliary lock with an anti-breakage device in the present invention, as shown in FIG. 1, comprises a seat 1, a base 2, an inner ring 3, an outer ring 4, a latch unit 5, a reinforcing plate 6 and a face plate 7 as main components.

The seat 1 is combined with the base 2 as a unit, by means of round projections 11 in the seat 1 fitting in holes 21 in the base 2 or by welding method. The seat 1 and the base 2 can also be formed as a unit. The seat 1 has round projections 11 on a flange at an end, an inner circular surface 12 to fit around a round edge projection 22 of the base 2, and a central hole 13 for an actuating plate 51 of the latch unit 5 to pass through.

The base 2 has a comparatively large flange to contact with the flange of the seat 1. The flange has holes 21 equally spaced apart to engage the projections 11 in the seat 1, or rivets can be substituted for the projections 11. The base 2 also has a round projecting end edge 22 at an end to fit around the inner surface 12 of the seat 1, and a comparatively long tubular post 23 to contain the latch unit 5 therein in a manner that an actuating plate 51 of the latch unit 5 protrudes through the projecting end edge 22. An end flat surface 24 of the tubular post 23 is in close contact with a bottom face of the inner annular lip 31 of the inner ring 3.

The inner ring 3 has a large diameter end and an other small diameter end. The large diameter end contacts the flange of the base 2 and the small diameter end has a recessed inner annular lip 31 for an annular lip 41 of the outer ring 4 to engage therein.

The outer ring 4 has a small diameter end which has a recessed annular lip 41 to engage the annular lip 31 of the inner ring 3 for disposing the latch unit 5 therein, and a large diameter end which has a bent flat lip 42 to cover the large diameter ends of both the base 2 and the seat 1 so as to form a combined housing.

The latch unit 5 is to be deposited in the combined housing formed by the seat 1, the base 2, the inner ring 3, and the outer ring 4, having a lengthwise actuating plate 51 extending through the central hole 13 in the seat 1, a large flange 52 at an end to fit around the annular lip 41 of the outer ring 4, screw holes 53 in the bottom for bolts to fix this lock, and a recessed opening in the flange end for a reinforcing plate 6 to fit therein. The actuating plate 51 is rotated together with a key block 55.

The reinforcing plate 6 is made of steel, stainless steel or very hard plate treated with heating process, and may be shaped a little curved up at the center or flat as another reinforcing plate 6'. The reinforcing plate 6, or 6' has a hole 61 (61') to fit with the key block 55 and becomes immovable after fitted in the opening 54.

The face plate 7 is to cover an outer end face of the latch unit 5, having a bent circumferential edge to seal up the reinforcing plate 6, and a cylindrical post 71 with a proper depth to extend in the hole 61 (61') of the reinforcing plate 6 (6') and to fit fixedly around the key block 55 of the latch unit 5.

Figure 2:
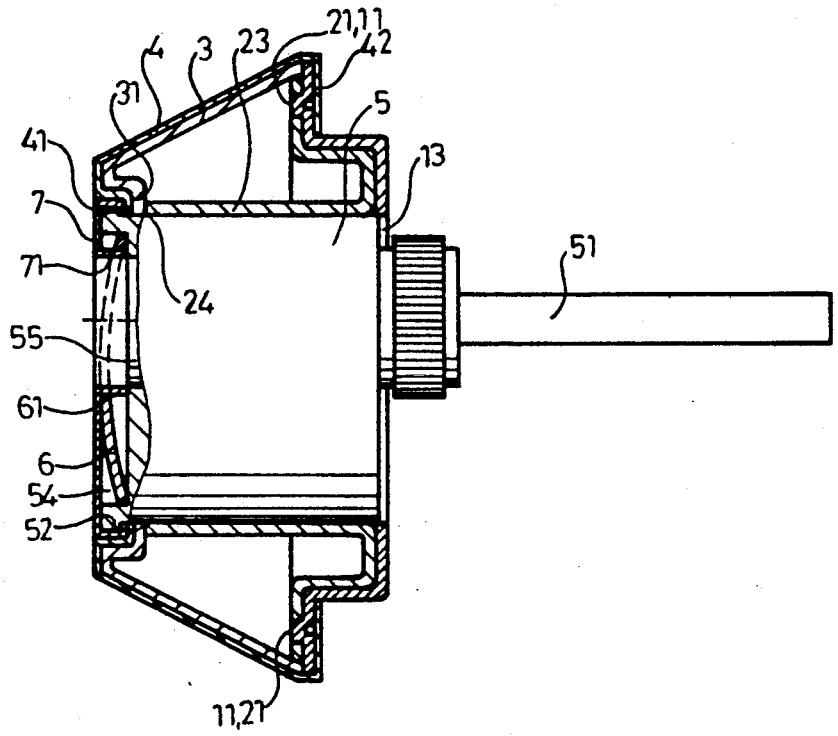
FIG. 2 is a cross-sectional view of the auxiliary lock with the anti-breakage device in the present invention.
Figure 3:
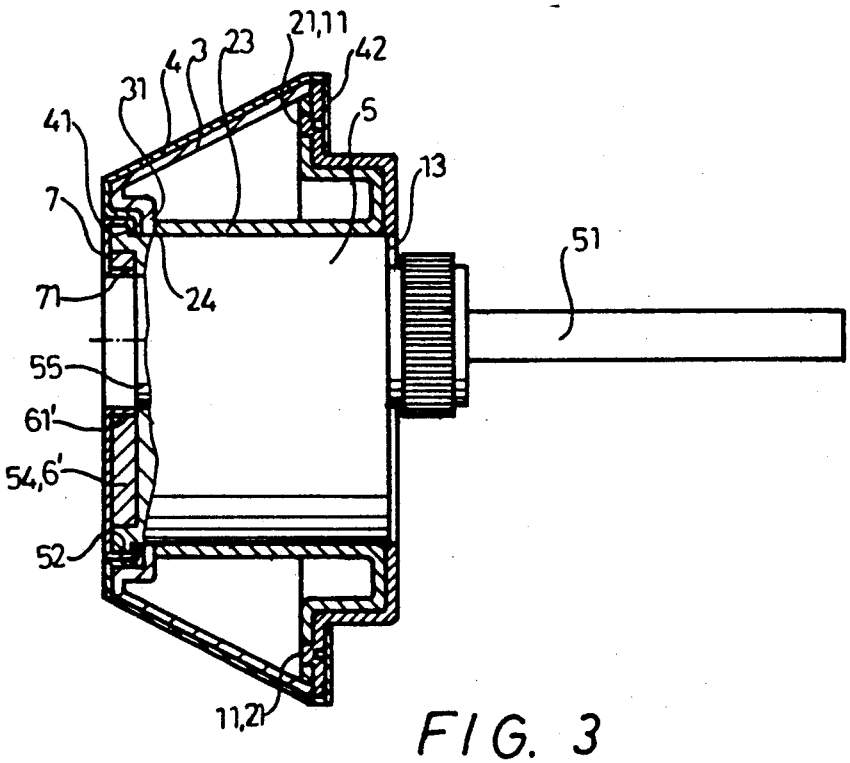
FIG. 3 is a cross-sectional view of an auxiliary lock with another embodiment of an anti-breakage device in the present invention.

As shown in FIG. 2, in this invention, the seat 1, the base 2, the inner ring 3 and the outer ring 4 are combined to form a housing for the latch unit 5, and those components can be made of a metal plate by means of a pressing process, resulting in reduced cost and weight. In addition, the combined housing can have enough hardness to resist illegal striking, twisting, boring etc. to prevent the latch unit from breakage. Provision of the reinforcing plate 6 (6') can resist boring, especially if it is curved up at the center.

What is claimed:

1. An auxiliary lock with an anti-breakage device comprising;

a seat having a large diameter flange at one end, a central hole another end for a lengthwise actuating plate of a latch unit to extend through, and an inner circumferential wall abutting the flange;

a base to combine with the seat, having a flange to contact circumferentially the flange of the seat, a projecting round edge at one end to fit around the central hole in the seat, and a tubular post extending to another end inside the base flange to contact an inner annular lip of an inner ring;

inner ring having a large diameter end to contact the flange of the base, a small diameter end with said recessed inner annular lip having one side to contact with an end face of the tubular post of the base and the other side to contact an inner annular lip of an outer ring;

said outer ring combined with an outer side of the inner ring, and having a small diameter end formed with said recessed annular lip to engage the inner annular lip of the inner ring;

said latch unit having a large flange at one end, a key block, said lengthwise actuating plate to rotate with the key block extending through the central hole of the seat, and a recessed opening in the end where the flange is located for a reinforcing plate to fit therein;

said reinforcing plate made of a hard metal, fitted in the recessed opening in the latch unit, and having a hole to fit around the key block; and a face plate covering the flange of the latch unit and the reinforcing plate to seal up the reinforcing plate, and having a cylindrical post to pass through the hole in the reinforcing plate and to fit fixedly around the key block.

2. The auxiliary lock with an anti-breakage device as claimed in claim 1, wherein said reinforcing plate is either shaped flat or curved up at its center.

* * * * *